US009726048B2

(12) United States Patent
Kasahara et al.

(10) Patent No.: US 9,726,048 B2
(45) Date of Patent: Aug. 8, 2017

(54) STEAM TURBINE PLANT

(71) Applicant: MITSUBISHI HEAVY INDUSTRIES, LTD., Tokyo (JP)

(72) Inventors: Jiro Kasahara, Tokyo (JP); Issaku Fujita, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 168 days.

(21) Appl. No.: 14/777,589

(22) PCT Filed: Mar. 18, 2014

(86) PCT No.: PCT/JP2014/057422

§ 371 (c)(1),
(2) Date: Sep. 16, 2015

(87) PCT Pub. No.: WO2014/148517

PCT Pub. Date: Sep. 25, 2014

(65) Prior Publication Data

US 2016/0290171 A1 Oct. 6, 2016

(30) Foreign Application Priority Data

Mar. 22, 2013 (JP) ..... 2013-059351

(51) Int. Cl.
*F01K 9/00* (2006.01)
*F01K 7/22* (2006.01)
(Continued)

(52) U.S. Cl.
CPC ..... *F01K 7/22* (2013.01); *F01K 7/38* (2013.01); *F01K 9/00* (2013.01); *F01K 9/023* (2013.01);
(Continued)

(58) Field of Classification Search
CPC ... F01K 7/22; F01K 9/023; F01K 7/38; F01K 11/02; F01K 9/00; F28B 9/00; F28B 1/02; F28B 7/00
(Continued)

(56) References Cited

U.S. PATENT DOCUMENTS 3,817,323 A * 6/1974 Ebara ..... F28B 1/02 165/110
3,892,548 A 7/1975 Gardey
(Continued)

FOREIGN PATENT DOCUMENTS

CN 2674109 1/2005
CN 1598250 3/2005
(Continued)

OTHER PUBLICATIONS

International Search Report issued Jun. 24, 2014 in corresponding International Application No. PCT/JP2014/057422 (with English translation).
(Continued)

*Primary Examiner* — Hoang Nguyen
(74) *Attorney, Agent, or Firm* — Wenderoth, Lind & Ponack, L.L.P.

(57) ABSTRACT

A steam turbine plant is provided with: a plurality of steam turbines; a multistage pressure condenser composed of a plurality of condensers which are respectively provided below the respective steam turbines so as to correspond to the plurality of steam turbines, and in which steam which is discharged from the respective steam turbines is condensed and accommodated as condensate; and a steam extraction section which introduces some of the steam in the steam turbine into condensate of the condenser corresponding to the lowest-pressure steam turbine among the plurality of condensers.

5 Claims, 3 Drawing Sheets

(51) Int. Cl.

| | |
|---|---|
| ***F28B 1/02*** | (2006.01) |
| ***F28B 7/00*** | (2006.01) |
| ***F28B 9/00*** | (2006.01) |
| ***F01K 11/02*** | (2006.01) |
| ***F01K 7/38*** | (2006.01) |
| ***F01K 9/02*** | (2006.01) |

(52) U.S. Cl.
CPC ..... *F01K 11/02* (2013.01); *F28B 1/02* (2013.01); *F28B 7/00* (2013.01); *F28B 9/00* (2013.01)

(58) Field of Classification Search
USPC ..... 60/653, 677–680, 685; 261/113, 141, 261/146, 157, DIG. 10
See application file for complete search history.

(56) References Cited

U.S. PATENT DOCUMENTS

| | | | | |
|---|---|---|---|---|
| 6,109,037 | A * | 8/2000 | Kumagai | F04F 5/26 60/677 |
| 6,814,345 | B2 * | 11/2004 | Inoue | F28B 1/02 261/113 |
| 8,360,402 | B2 | 1/2013 | Sugitani et al. | |
| 8,505,886 | B2 * | 8/2013 | Yadorihara | F28B 1/02 261/113 |
| 2002/0050149 | A1 * | 5/2002 | Kawada | F25B 1/10 62/510 |
| 2010/0319879 | A1 | 12/2010 | Sugitani et al. | |
| 2012/0216541 | A1 | 8/2012 | Fujita et al. | |

FOREIGN PATENT DOCUMENTS

| | | |
|---|---|---|
| CN | 101828090 | 9/2010 |
| CN | 202002081 | 10/2011 |
| EP | 2 199 720 | 6/2010 |
| JP | 61-11590 | 1/1986 |
| JP | 61-59187 | 3/1986 |
| JP | 61-168787 | 7/1986 |
| JP | 2009-097788 | 5/2009 |
| JP | 2010-223105 | 10/2010 |
| JP | 2012-137266 | 7/2012 |
| WO | 2012/090778 | 7/2012 |
| WO | 2012/117597 | 9/2012 |

OTHER PUBLICATIONS

Written Opinion of the International Searching Authority issued Jun. 24, 2014 in corresponding International Application No. PCT/JP2014/057422 (with English translation).
Extended European Search Report issued Feb. 16, 2016 in corresponding European Application No. 14770691.5.
Office Action issued Mar. 30, 2016 in corresponding Chinese Application No. 201480016351.X (with English Translation of Search Report).

* cited by examiner

STEAM TURBINE PLANT

TECHNICAL FIELD

The present invention relates to a steam turbine plant and particularly to a steam turbine plant having a multistage pressure condenser. Priority is claimed on Japanese Patent Application No. 2013-059351, filed Mar. 22, 2013, the content of which is incorporated herein by reference.

BACKGROUND ART

In general, in a steam turbine plant or the like, steam having driven a steam turbine is exhausted from the turbine and led to a condenser. The steam led to the condenser is condensed by heat exchange with cooling water led to the condenser, thereby returning to water (condensate). The condensate condensed in the condenser is heated through a feed-water heater and supplied to a boiler. The heated condensate supplied to the boiler becomes steam and is used as a drive source of the steam turbine.

In a case where the condensate condensed in the condenser is sent to the feed-water heater, the higher the temperature of the condensate, the more it becomes advantageous in terms of the efficiency of a plant, and therefore, a multistage pressure condenser composed of a plurality of chambers having different pressures is used. As the multistage pressure condenser, for example, Patent Document 1 discloses.

In the multistage pressure condenser disclosed in Patent Document 1, a lower portion of a low-pressure chamber is partitioned by a pressure bulkhead and a reheat chamber in which low-pressure side condensate is introduced and accumulated is provided. Further, a bypass connecting pipe which allows high-pressure steam into a high-pressure chamber which is a chamber on the high-pressure side to be introduced into the reheat chamber and causes high-pressure side condensate having bypassed the reheat chamber and the low-pressure side condensate having come out of the reheat chamber to join, thereby raising the temperature of condensate, is provided in the multistage pressure condenser disclosed in Patent Document 1.

Further, in the multistage pressure condenser, a configuration is made in which efficiency is further improved by providing a heat transfer tube which is submerged in condensate and introducing an extracted steam of a deaerator which performs the deaeration of feed water which is supplied to, for example, a nuclear reactor, into the heat transfer tube.

PRIOR ART DOCUMENT

Patent Document

Patent Document 1: Japanese Unexamined Patent Application, First Publication No. 2009-97788

SUMMARY OF INVENTION

Technical Problem

However, since a lot of non-condensable gases are included in the extracted steam of the deaerator, it is not possible to directly inject the extracted steam into condensate, and in addition, since the amount of the extracted steam of the deaerator is also limited, there is a limit on improvement of reheating efficiency.

The present invention provides a steam turbine plant having a multistage pressure condenser enabling further improvement of reheating efficiency than in a multistage pressure condenser of the related art.

Technical Solution

According to a first aspect of the present invention, there is provided a steam turbine plant including: a plurality of steam turbines; a multistage pressure condenser composed of a plurality of condensers which are respectively provided below the respective steam turbines so as to correspond to the plurality of steam turbines, and in which steam which is discharged from the respective steam turbines is condensed and accommodated as condensate; and a steam extraction section which introduces some of the steam in the steam turbine into condensate of the condenser corresponding to the lowest-pressure steam turbine among the plurality of condensers.

According to the above configuration, by using some of the steam of the steam turbine as a heating source of the condensate, it is possible to raise the temperature of the condensate more efficiently than in the related art.

In the above steam turbine plant, the steam extraction sections may be provided in at least two steam turbines among the plurality of steam turbines, and by performing control such that at least one steam extraction section among the steam extraction sections of the at least two steam turbines is selected, steam extraction may be carried out by the at least one steam extraction section.

According to the above configuration, selection of the steam extraction section having an appropriate pressure, or mixing of steam from the plurality of steam extraction sections becomes possible, and therefore, it is possible to introduce steam having a more appropriate steam condition into condensate.

In the above steam turbine plant, the steam extraction section may be configured such that steam extraction is performed from a steam extraction stage having an appropriate pressure.

According to the above configuration, mixing of extracted steam from the plurality of steam extraction stages becomes possible, and therefore, it is possible to extract steam having a more appropriate steam condition to a reheat chamber.

In the above steam turbine plant, the condenser corresponding to the lowest-pressure steam turbine may have a steam injection device that directly injects the steam to the condensate, and introduction of the steam into the condensate of the condenser by the steam extraction section may be performed through the steam injection device.

According to the above configuration, by directly injecting the steam of the steam turbine, it is possible to reliably carry out heat exchange. Further, it is also possible to obtain an effect of stirring the condensate.

In the above steam turbine plant, a configuration may be made in which the condenser corresponding to the lowest-pressure steam turbine has a heat transfer tube which passes through the inside of the condensate and introduction of the steam to the condensate of the condenser by the steam extraction section is performed through the heat transfer tube.

According to the above configuration, even in a case where a non-condensable gas is included in steam which is extracted, it is possible to use the steam of the steam turbine as a heating source used to heat a condensate.

In the above steam turbine plant, the multistage pressure condenser may include: a plurality of chambers having different pressures; a pressure bulkhead which divides a low-pressure chamber which is the chamber on the low-pressure side, in a vertical direction and is provided with a perforated plate having a plurality of holes; a cooling water tube group which is provided in an upper portion of the low-pressure chamber partitioned by the pressure bulkhead, and into which cooling water is introduced, thereby performing heat exchange with low-pressure side steam led to the low-pressure chamber, and thereby condensing the low-pressure side steam into low-pressure side condensate; a reheat chamber which is a lower portion of the low-pressure chamber partitioned by the pressure bulkhead, and in which the low-pressure side condensate flowing down from the holes of the pressure bulkhead is accumulated; and a high-pressure side steam introduction device that introduces high-pressure side steam into a high-pressure chamber which is the chamber on the high-pressure side, into the reheat chamber.

According to the above configuration, in addition to the high-pressure side steam in the high-pressure chamber, some of the steam of the steam turbine is used as a heating source used to heat a condensate, whereby it is possible to raise the temperature of the condensate more efficiently than in the related art.

Advantageous Effects

According to the steam turbine plant described above, by using some of the steam of a steam turbine as a heating source used to heat a condensate, it is possible to raise the temperature of the condensate more efficiently than in the related art.

DESCRIPTION OF EMBODIMENTS

First Embodiment

Figure 1:
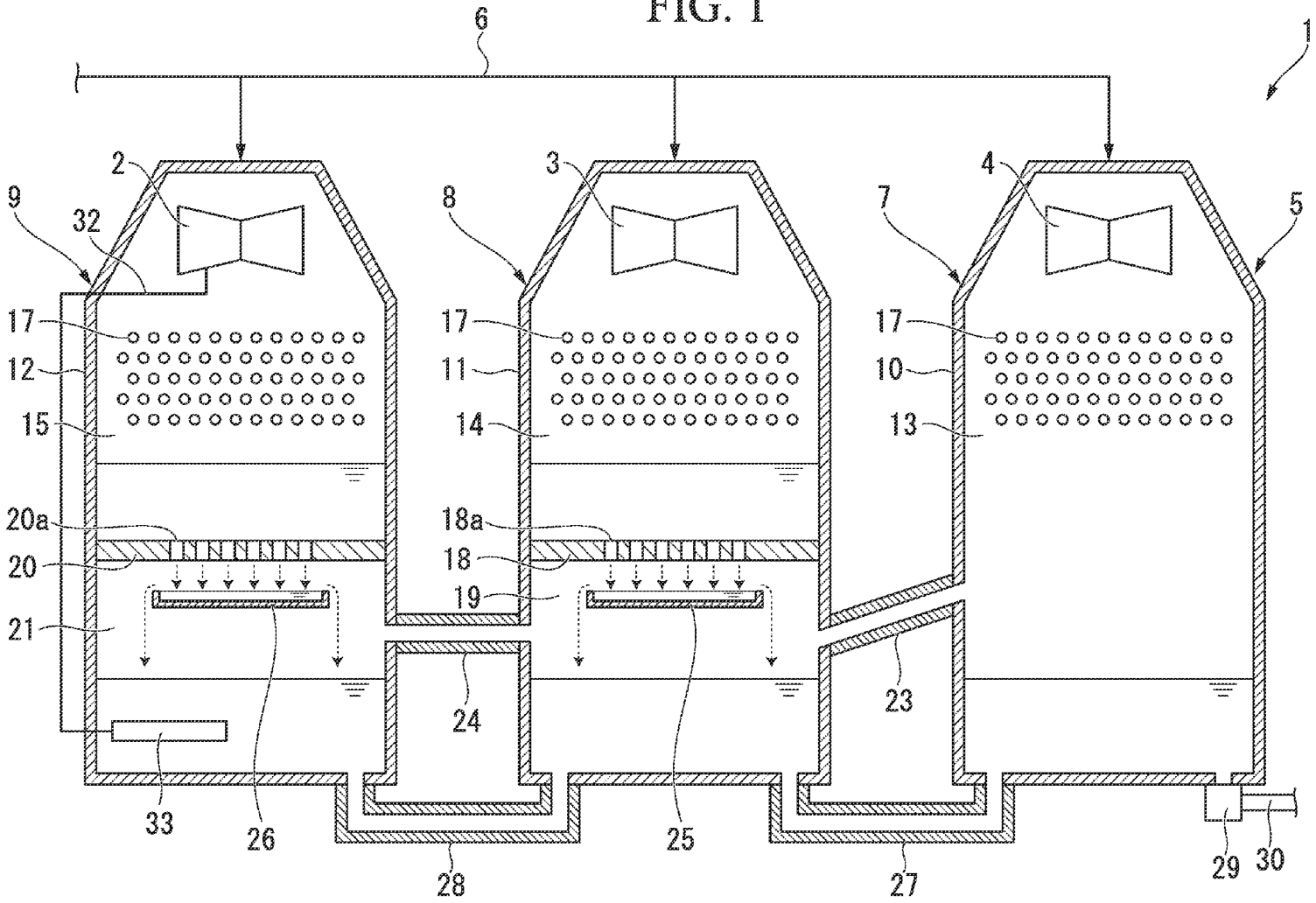
FIG. 1 is a schematic configuration diagram of a steam turbine plant of a first embodiment of the present invention.

Hereinafter, an embodiment of the present invention will be described in detail with reference to the drawing.

As shown in FIG. 1, a steam turbine plant 1 of this embodiment has: a plurality of low-pressure turbines which include a first low-pressure turbine 2, a second low-pressure turbine 3, and a third low-pressure turbine 4; a multistage pressure condenser 5 composed of a plurality of condensers 7, 8, and 9 which are respectively provided below the respective low-pressure turbines so as to correspond to the plurality of low-pressure turbines and in which steam which is discharged from the respective low-pressure turbines is condensed and accommodated as condensate; and a boiler (not shown).

The plurality of low-pressure turbines 2, 3, and 4 are connected to a high-pressure turbine (not shown) through a pipe 6. The multistage pressure condenser 5 is a three-barrel type multistage pressure condenser configured by connecting three condensers 7, 8, and 9: a high-pressure stage condenser 7, a medium-pressure stage condenser 8, and a low-pressure stage condenser 9. The plurality of low-pressure turbines 2, 3, and 4 are respectively mounted on upper portions of the low-pressure stage condenser 9, the medium-pressure stage condenser 8, and the high-pressure stage condenser 7.

A high-pressure barrel 10 into which exhaust steam from the low-pressure turbine 4 is introduced from the upper portion of the high-pressure stage condenser 7 is provided in the high-pressure stage condenser 7. A medium-pressure barrel 11 into which exhaust steam from the low-pressure turbine 3 is introduced from the upper portion of the medium-pressure stage condenser 8 is provided in the medium-pressure stage condenser 8. A low-pressure barrel 12 into which exhaust steam from the low-pressure turbine 2 is introduced from the upper portion of the low-pressure stage condenser 9 is provided in the low-pressure stage condenser 9.

Further, a high-pressure chamber 13, a medium-pressure chamber 14, and a low-pressure chamber 15 are respectively formed in the insides of the high-pressure barrel 10, the medium-pressure barrel 11, and the low-pressure barrel 12. Further, a cooling water tube group 17 composed of a large number of heat transfer tubes is disposed so as to pass through the high-pressure chamber 13, the medium-pressure chamber 14, and the low-pressure chamber 15. Cooling water in the cooling water tube group 17 flows in order from the low-pressure chamber 15, through the medium-pressure chamber 14, and into the high-pressure chamber 13, and therefore, the pressure in each chamber is set in descending order in the high-pressure chamber 13, the medium-pressure chamber 14, and the low-pressure chamber 15.

A first pressure bulkhead 18 which is horizontal with respect to the bottom surface of the medium-pressure barrel 11 is fixed to a lower portion of the medium-pressure barrel 11. The medium-pressure barrel 11 is divided into the medium-pressure chamber 14 on the upper side and a first reheat chamber 19 on the lower side, in a vertical direction. Further, a second pressure bulkhead 20 which is horizontal with respect to the bottom surface of the low-pressure barrel 12 is fixed to a lower portion of the low-pressure barrel 12. The low-pressure barrel 12 is partitioned into the low-pressure chamber 15 on the upper side and a second reheat chamber 21 on the lower side. Each of the pressure bulkheads 18 and 20 is a perforated plate, and condensate introduction holes 18*a* and 20*a* are formed in a predetermined area of a central portion.

Further, the high-pressure chamber 13 communicates with the first reheat chamber 19 of the medium-pressure barrel 11 through a first steam duct 23 (a high-pressure side steam introduction device), and thus high-pressure steam in the high-pressure chamber 13 is sent to the first reheat chamber 19 through the first steam duct 23. Further, the medium-pressure barrel 11 communicates with the second reheat chamber 21 of the low-pressure barrel 12 through a second steam duct 24, and thus the high-pressure steam in the high-pressure chamber 13 is sent to the second reheat chamber 21 through the first steam duct 23, the first reheat chamber 19 of the medium-pressure barrel 11, and the second steam duct 24.

In the first reheat chamber 19 of the medium-pressure barrel 11, a first tray 25 which is a receiving member is disposed horizontally with respect to the bottom surface of the medium-pressure barrel 11. The first tray 25 is set to be wider than the area in which the condensate introduction holes 18*a* are formed, of the first pressure bulkhead 18, below the area, and is configured so as to be able to receive medium-pressure condensate dripping from the condensate introduction holes 18*a*. Further, the first tray 25 is configured so as to cause the received medium-pressure condensate to overflow and fall from an outer peripheral portion and to cause the medium-pressure condensate to be accumulated as condensate in the first reheat chamber 19.

Further, in the second reheat chamber 21 of the low-pressure barrel 12, a second tray 26 is disposed horizontally with respect to the bottom surface of the low-pressure barrel 12. The second tray 26 is set to be wider than the area in which the condensate introduction holes 20*a* are formed, of the second pressure bulkhead 20, below the area, and is configured so as to be able to receive low-pressure condensate dripping from the condensate introduction holes 20*a*. Further, the second tray 26 is configured so as to cause the received low-pressure condensate to overflow and fall from an outer peripheral portion and to cause the low-pressure condensate to be accumulated as condensate in the second reheat chamber 21.

Further, the high-pressure chamber 13 and the first reheat chamber 19 of the medium-pressure barrel 11 are connected by a first connecting pipe 27, the first reheat chamber 19 of the medium-pressure barrel 11 and the second reheat chamber 21 of the low-pressure barrel 12 are connected by a second connecting pipe 28, and a cooling water pipe 30 is connected to a discharge section 29 provided at a lower portion of the high-pressure chamber 13.

Further, a first end of an extracted steam flow path 32 which is a steam extraction section which extracts some of the steam driving the first low-pressure turbine 2 is connected to the first low-pressure turbine 2 of this embodiment. Further, an extracted steam injection tube 33 functioning as steam injection means is disposed below the second reheat chamber 21 of the low-pressure stage condenser 9. The extracted steam injection tube 33 is a nozzle configured so as to be able to inject a fluid introduced into the inside thereof to the outside and is disposed at a position where it is submerged in the condensate accumulated in the second reheat chamber 21.

Further, a second end of the extracted steam pathway is connected to the extracted steam injection tube 33. That is, in the steam turbine plant 1 of this embodiment, it is possible to introduce the extracted steam of the first low-pressure turbine 2 into the condensate in the second reheat chamber 21 through the extracted steam injection tube 33.

Here, an operation of the steam turbine plant 1 of this embodiment will be described in detail.

The exhaust steam from the low-pressure turbines 2, 3, and 4 in the steam turbine plant 1 is sent to the high-pressure chamber 13, the medium-pressure chamber 14, and the low-pressure chamber 15 in the multistage pressure condenser 5. The exhaust steam which moves downward through the high-pressure chamber 13, the medium-pressure chamber 14, and the low-pressure chamber 15 is condensed by the contact with the cooling water tube group 17. Then, the high-pressure condensate condensed in the high-pressure chamber 13 is accumulated at the lower portion of the high-pressure chamber 13. Further, the medium-pressure condensate condensed in the medium-pressure chamber 14 is accumulated at the lower portion of the medium-pressure chamber 14. The low-pressure condensate condensed in the low-pressure chamber 15 is accumulated at the lower portion of the low-pressure chamber 15.

At this time, the medium-pressure condensate condensed in the medium-pressure chamber 14 is temporarily accumulated on the first pressure bulkhead 18 and drops from the condensate introduction holes 18*a*, thereby falling onto and being accumulated on the first tray 25 of the first reheat chamber 19. Then, the medium-pressure condensate on the first tray 25 overflows and falls in the first reheat chamber 19. The high-pressure steam in the high-pressure chamber 13 is sent to the first reheat chamber 19 through the first steam duct 23, and the medium-pressure condensate dripping from the condensate introduction holes 18*a* onto the first tray 25 drops in the high-pressure steam, thereby being heated due to contact heat transfer. Further, the medium-pressure condensate overflowing the first tray 25 drops in the high-pressure steam, thereby being heated due to contact heat transfer.

Further, similarly, the low-pressure condensate condensed in the low-pressure chamber 15 is temporarily accumulated on the second pressure bulkhead 20 and drops from the condensate introduction holes 20*a*, thereby falling onto and being accumulated on the second tray 26 of the second reheat chamber 21. Then, the low-pressure condensate on the second tray 26 overflows and falls in the second reheat chamber 21. The high-pressure steam in the medium-pressure chamber 14 is sent to the second reheat chamber 21 through the second steam duct 24, and the low-pressure condensate dripping from the condensate introduction holes 20*a* onto the second tray 26 drops in the high-pressure steam, thereby being heated due to contact heat transfer. Further, the low-pressure condensate overflowing the second tray 26 drops in the high-pressure steam, and is thereby heated due to contact heat transfer.

Further, the low-pressure condensate accumulated in the second reheat chamber 21 of the low-pressure barrel 12 flows to the first reheat chamber 19 of the medium-pressure barrel 11 through the second connecting pipe 28. Next, the mixed condensate of the low-pressure condensate and the medium-pressure condensate mixed in the first reheat chamber 19 flows to the high-pressure chamber 13 through the first connecting pipe 27. Further, the mixed condensate of the low-pressure condensate, the medium-pressure condensate, and the high-pressure condensate mixed in the high-pressure chamber 13 is discharged from the discharge section 29 to the cooling water pipe 30.

On the other hand, some of the steam of the first low-pressure turbine 2 is sent to the second reheat chamber 21 through the extracted steam flow path 32. Some of the steam is injected to the condensate in the second reheat chamber 21 by the extracted steam injection tube 33. The condensate accumulated in the second reheat chamber 21 is heated by the steam injected from the extracted steam injection tube 33.

According to the above-described embodiment, in addition to the steam of the high-pressure stage condenser 7, the extracted steam of the low-pressure turbine 2 is used as a heating source used to heat a condensate, whereby it is possible to raise the temperature of condensate more efficiently than in the related art.

Further, it is also possible to obtain an effect of stirring condensate.

In addition, in this embodiment, the low-pressure turbine in which steam extraction is performed is the turbine in the low-pressure chamber 15. However, steam extraction from the low-pressure turbines in the medium-pressure chamber 14 and the high-pressure chamber 13 may be performed.

Second Embodiment

Hereinafter, a steam turbine plant 1B according to a second embodiment of the present invention will be described based on the drawing. In addition, in this embodiment, a description will be made focusing on a difference from the first embodiment described above, and with respect to the same portions, the description thereof is omitted.

Figure 2:
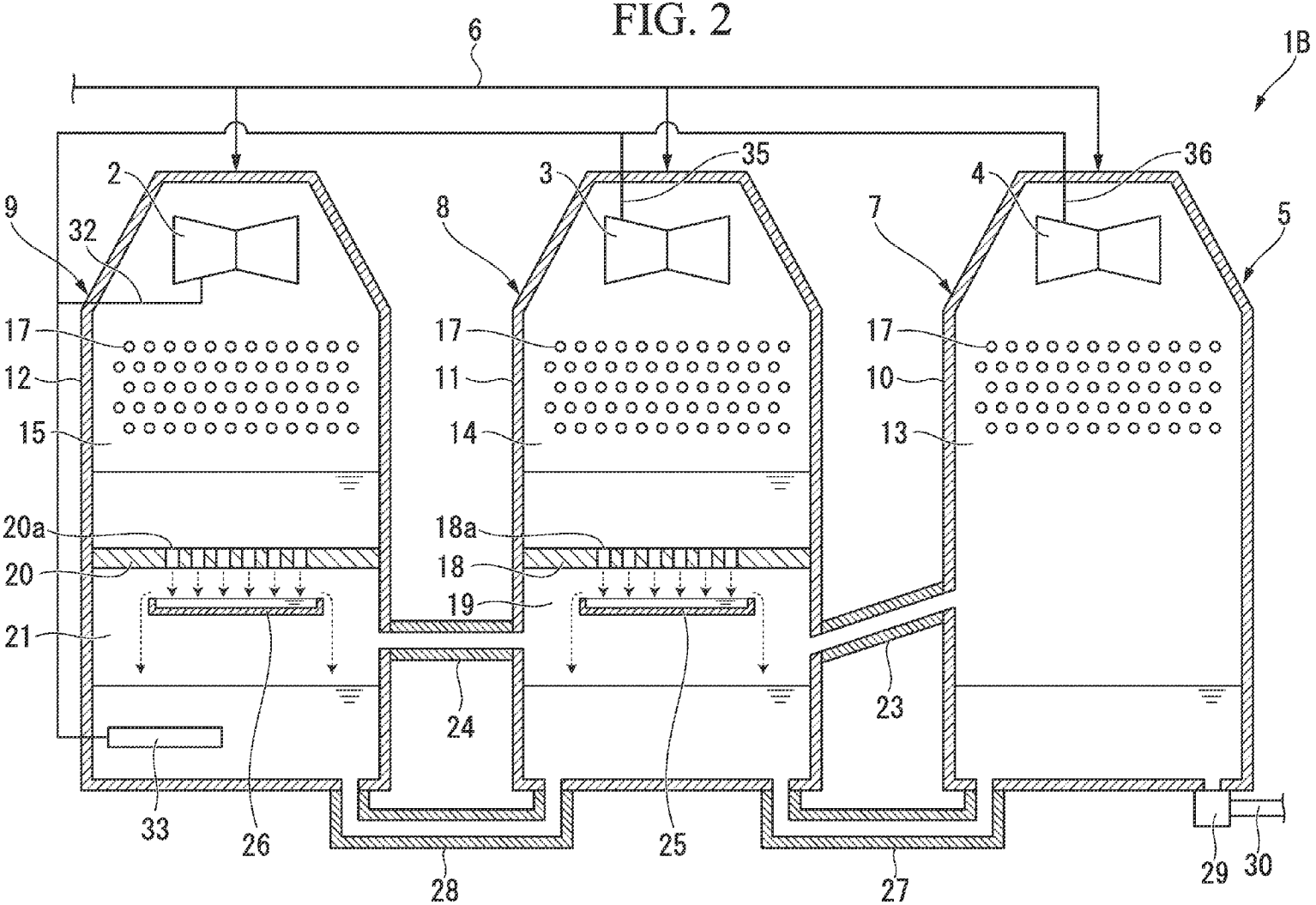
FIG. 2 is a schematic configuration diagram of a steam turbine plant of a second embodiment of the present invention.

As shown in FIG. 2, the steam turbine plant 1B of this embodiment has a configuration in which compared to the steam turbine plant 1 of the first embodiment in which steam is extracted from only the first low-pressure turbine 2, it is possible to perform the control of steam extraction selectively from at least one low-pressure turbine among the first low-pressure turbine 2, the second low-pressure turbine 3, and the third low-pressure turbine 4.

Specifically, a first end of a first extracted steam flow path 32 is connected to the first low-pressure turbine 2. A first end of a second extracted steam flow path 35 is connected to the second low-pressure turbine 3. A first end of a third extracted steam flow path 36 is connected to the third low-pressure turbine 4. Second ends of the extracted steam flow paths 32, 35, and 36 are connected to the extracted steam injection tube 33.

Further, steam extraction of the low-pressure turbine is configured such that steam extraction is performed from a steam extraction stage (a pressure stage) having an appropriate pressure. For example, a steam extraction stage going back by about two stages from the outlet side of each of the low-pressure turbines 2, 3, and 4 is preferable when taking into account a differential pressure or the like between itself and each of the extracted steam flow paths 32, 35, and 36. Further, it is preferable that the selection of the steam extraction stage is designed in consideration of steam extraction efficiency. For example, it is preferable that it is designed such that drainage (condensed steam) does not flow downstream as much as possible and that a minimum amount of steam be used in the steam extraction side is decreased.

According to the above-described embodiment, mixing of extracted steam from a plurality of steam extraction stages becomes possible, and therefore, it is possible to extract steam having a more appropriate steam condition to a reheat chamber.

Here, a modified example of each of the above-described embodiments will be described.

Figure 3:
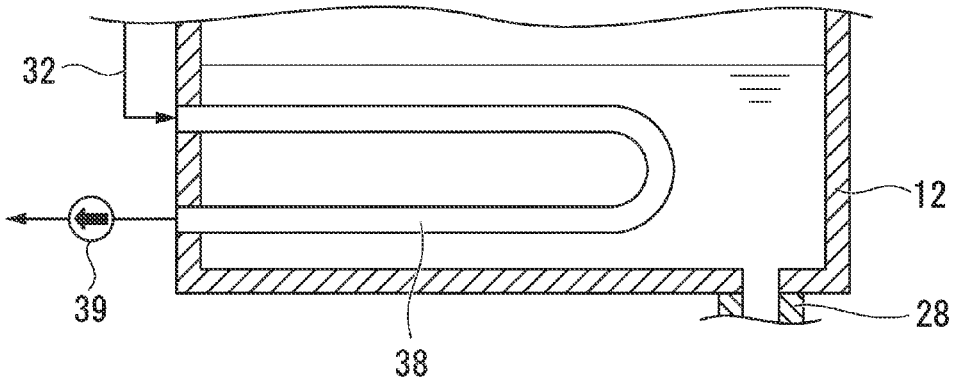
FIG. 3 is a schematic configuration diagram of a heat transfer tube of a modified example according to the first and second embodiments of the present invention.

In this modified example, as shown in FIG. 3, a configuration in which a heat transfer tube 38 is provided so as to pass through condensate and the extracted steam is introduced into the heat transfer tube 38, is used. That is, a configuration in which some of the steam of a low-pressure turbine is directly introduced into condensate is not used, and a configuration in which the heat of steam is transferred to condensate through the heat transfer tube 38 is used. The steam introduced into the heat transfer tube 38 may be drawn out by a pump such as a vacuum pump 39 and may be supplied to a predetermined flash box.

According to the above-described modified example, even in a case where a non-condensable gas is included in steam which is extracted, it is possible to use the steam of a steam turbine as a heating source used to heat a condensate.

In addition, the technical scope of the present invention is not limited to the embodiments described above and it is possible to add various changes thereto within a scope which does not depart from the gist of the present invention. Further, a configuration in which the features described in the plurality of embodiments described above are arbitrarily combined with each other is also acceptable.

For example, in each of the above-described embodiments, description has been made as the three-barrel type multistage pressure condenser. However, even in a two-barrel type multistage pressure condenser which is composed of a low-pressure stage condenser and a high-pressure stage condenser, or a multistage pressure condenser which is configured with a condenser having four or more barrels, it is possible to apply the present invention thereto.

Further, in each of the above-described embodiments, a configuration in which the extracted steam is depressurized to an appropriate pressure by an expansion valve or the like may be added, as necessary.

INDUSTRIAL APPLICABILITY

According to the steam turbine plant described above, by using some of the steam of a steam turbine as a heating source used to heat a condensate, it is possible to raise the temperature of the condensate more efficiently than in the related art.

REFERENCE SIGNS LIST

1: steam turbine plant
2: first low-pressure turbine (steam turbine)
3: second low-pressure turbine (steam turbine)
4: third low-pressure turbine (steam turbine)
5: multistage pressure condenser
6: pipe
7: high-pressure stage condenser
8: medium-pressure stage condenser
9: low-pressure stage condenser
10: high-pressure barrel
11: medium-pressure barrel
12: low-pressure barrel
13: high-pressure chamber
14: medium-pressure chamber
15: low-pressure chamber
17: cooling water tube group
18: first pressure bulkhead
19: first reheat chamber
20: second pressure bulkhead
21: second reheat chamber
23: first steam duct (high-pressure side steam introduction device)
24: second steam duct (high-pressure side steam introduction device)
25: first tray
26: second tray
27: first connecting pipe
28: second connecting pipe
29: discharge section
30: cooling water pipe
32: extracted steam flow path (steam extraction section)
33: extracted steam injection tube (steam injection device)

The invention claimed is:

1. A steam turbine plant comprising:

a plurality of steam turbines;

a multistage pressure condenser composed of a plurality of condensers which are respectively provided below the respective steam turbines so as to correspond to the plurality of steam turbines, and in which steam which is discharged from the respective steam turbines is condensed and accommodated as condensate; and a steam extraction section which introduces some of the steam driving the steam turbine into condensate of the condenser corresponding to the lowest-pressure steam turbine among the plurality of condensers, wherein the condenser corresponding to the lowest-pressure steam turbine has a steam injection device that directly injects the steam to the condensate, and wherein introduction of the steam into the condensate of the condenser by the steam extraction section is performed through the steam injection device.

2. The steam turbine plant according to claim 1, wherein the steam extraction section includes a plurality of the steam extraction sections, the plurality of the steam extraction sections are provided in at least two steam turbines among the plurality of steam turbines, and by performing control such that at least one steam extraction section among the steam extraction sections of the at least two steam turbines is selected, steam extraction is carried out by the at least one steam extraction section.

3. The steam turbine plant according to claim 2, wherein the steam extraction section is configured such that steam extraction is performed from a steam extraction stage having an appropriate pressure.

4. The steam turbine plant according to claim 1, wherein the condenser corresponding to the lowest-pressure steam turbine has a heat transfer tube which passes through the inside of the condensate, and the steam to the condensate of the condenser by the steam extraction section is introduced into the heat transfer tube.

5. The steam turbine plant according to claim 1, wherein the multistage pressure condenser includes:

a plurality of chambers having different pressures;

a pressure bulkhead which divides a low-pressure chamber which is the chamber on the low-pressure side, in a vertical direction and is provided with a perforated plate having a plurality of holes;

a cooling water tube group which is provided in an upper portion of the low-pressure chamber partitioned by the pressure bulkhead, and into which cooling water is introduced, thereby performing heat exchange with low-pressure side steam led to the low-pressure chamber, and thereby condensing the low-pressure side steam into low-pressure side condensate;

a reheat chamber which is a lower portion of the low-pressure chamber partitioned by the pressure bulkhead, and in which the low-pressure side condensate flowing down from the holes of the pressure bulkhead is accumulated; and a high-pressure side steam introduction device that introduces high-pressure side steam into a high-pressure chamber which is the chamber on the high-pressure side, into the reheat chamber.

* * * * *